US008714463B2

(12) United States Patent
Bischoff et al.

(10) Patent No.: US 8,714,463 B2
(45) Date of Patent: May 6, 2014

(54) OVERHEAD OR LATERAL SHOWER HEAD

(75) Inventors: Bernd Bischoff, Hemer (DE); Claudia Schroeder, Iserlohn (DE)

(73) Assignee: Grohe AG, Hemer (DE)

( * ) Notice: Subject to any disclaimer, the term of this patent is extended or adjusted under 35 U.S.C. 154(b) by 205 days.

(21) Appl. No.: 12/986,907

(22) Filed: Jan. 7, 2011

(65) Prior Publication Data

US 2011/0163182 A1 Jul. 7, 2011

Related U.S. Application Data

(63) Continuation of application No. PCT/EP2009/004841, filed on Jul. 4, 2009.

(30) Foreign Application Priority Data

Jul. 7, 2008 (DE) ..... 10 2008 031 558

(51) Int. Cl.
*B05B 15/06* (2006.01)
*B05B 3/16* (2006.01)
*B05B 1/32* (2006.01)

(52) U.S. Cl.
USPC ..... 239/209; 239/242; 239/538

(58) Field of Classification Search
USPC ..... 239/209, 240, 242, 225.1, 538, 537, 239/540
See application file for complete search history.

(56) References Cited

U.S. PATENT DOCUMENTS

| | | | | | |
|---|---|---|---|---|---|
| 3,979,064 | A * | 9/1976 | Nordentoft | ..... | 239/107 |
| 5,205,490 | A * | 4/1993 | Steinhardt et al. | ..... | 239/449 |
| 5,265,287 | A * | 11/1993 | Henkin et al. | ..... | 4/605 |
| 5,810,262 | A * | 9/1998 | Ton | ..... | 239/428.5 |
| 7,246,760 | B2 * | 7/2007 | Marty et al. | ..... | 239/587.4 |
| 7,628,341 | B2 | 12/2009 | Kajuch | | |
| 7,770,825 | B2 | 8/2010 | Kajuch | | |
| 2001/0008256 | A1 * | 7/2001 | Marsh et al. | ..... | 239/381 |
| 2004/0026542 | A1 | 2/2004 | Loyd et al. | | |

FOREIGN PATENT DOCUMENTS

| | | |
|---|---|---|
| DE | 196 50 971 A1 | 6/1998 |
| DE | 100 11 504 A1 | 9/2001 |
| WO | WO 2006/093954 | 9/2006 |

* cited by examiner

*Primary Examiner* — Justin Jonaitis
(74) *Attorney, Agent, or Firm* — Muncy, Geissler, Olds & Lowe, PLLC

(57) ABSTRACT

A shower head or lateral shower head is provided for installation in a ceiling or wall, having a pivotable jet-producing device which is mounted in a ball housing by a ball-and-socket joint through which water flows, the housing surrounding the jet-producing device and being arranged in a manner both tiltable and displaceable in a direction perpendicular to the ceiling or wall, and the housing having an outer flange which extends to the surface of the ceiling or wall. A connection element is provided between a water connection and the ball housing.

17 Claims, 4 Drawing Sheets

OVERHEAD OR LATERAL SHOWER HEAD

This nonprovisional application is a continuation of International Application No. PCT/EP2009/004841, which was filed on Jul. 4, 2009, and which claims priority to German Patent Application No. DE 10 2008 031 558.3, which was filed in Germany on Jul. 7, 2008, and which are both herein incorporated by reference.

BACKGROUND OF THE INVENTION

1. Field of the Invention

The present invention relates to an overhead or lateral showerhead for installation in a ceiling or wall with a pivotable jet producing unit.

2. Description of the Background Art

In fixedly installed overhead or lateral showerheads, it is advantageous for the tilt and direction of the spray jet to be varied. In modern overhead and lateral showerheads, it is desirable in addition that these be made as flat as possible or even almost flush with the ceiling or wall surface. For example, DE 100 11 504 A1 discloses a showerhead with a spherical section and a spherical shell, which in turn has guides arranged perpendicular to one another, so that the showerhead can be moved in a vertical and a horizontal axis. Furthermore, WO 2006/093954 A1, which corresponds to U.S. Pat. Nos. 7,628,341 and 7,770,825, discloses a lateral showerhead for installation in a wall, whose jet producing element is pivotable all around by means of a coupling assembly rotatable around two axes arranged perpendicular to one another.

If the showerhead is to be flush with the ceiling or wall surface, apart from the flattest construction and design possible, it is necessary for the showerhead to be adaptable to different wall thicknesses or to different wall constructions or coverings.

SUMMARY OF THE INVENTION

It is therefore an object of the present invention to provide a design for overhead and lateral showerheads that meet the aforementioned requirements.

The invention provides an overhead or lateral showerhead for installation in a wall or ceiling which has a pivotable jet producing unit. The jet producing unit is mounted by means of a ball joint, through which water flows, and whose associated ball housing surrounds the jet producing unit and is arranged tiltable. Further, the ball housing has an outer flange, which extends to the ceiling or wall surface. An overhead or lateral showerhead with very small depth is achieved by the compact design of the ball joint subassembly, which comprises the ball housing and the ball joint, and the jet producing unit. To adapt to different ceiling or wall thicknesses, a connection element is provided between a water connection and the ball housing. This makes possible the displaceable arrangement of the ball housing substantially perpendicular to the ceiling or wall surface. Overall, apart from the depth compensation, a fine adjustment of the showerhead and optionally an angle adjustment to adapt to possible slanting of the ceiling or wall are possible.

According to an embodiment of the invention, fasteners are provided with which the ball housing is fixed to the connection element and simultaneously the outer flange of the ball housing is secured against the ceiling or wall surface.

Particularly in the case of overhead or lateral showerheads with an angular outer contour, it is advantageous when the ball housing can be fastened to a disk or annular disk, mounted rotatably on the connection element, by means of screws, because the orientation of the showerhead can then occur independent of the position of the fastener. Because of the rotatable arrangement of the annular disk, the position of the screw holes can be matched to the position of the ball housing. The orientation of the ball housing does not need to be changed further during the fixation thereof.

The annular disk contains a plurality of tapped holes for receiving the screws and is mounted securely in a groove on the connection element in the axial direction. The ball housing can be oriented initially according to the wall covering, so that in the case of rectangular showerheads the housings are oriented precisely horizontally and vertically. Then, the ball housing is fastened to the connection element, used for depth adjustment, by means of screws. To this end, the connection element can be shortened and/or be made of multiple parts.

The connection element comprises a connection thread on the one side, which corresponds to the thread of the water connection. On the side facing the jet producing unit, the cross section of the connection element increases abruptly, so that a seat for a connection fitting of the ball housing is formed. Advantageously, the connection element and/or seat for the connection fitting of the ball housing are formed rotationally symmetric, so that the position of the connection element is immaterial for the orientation of the ball housing. The connection fitting of the ball housing is guided in turn displaceably and tiltably in the seat of the connection element. Its final position and thereby the position of the ball housing are also determined by the screws described above. As a result, an especially fine orientation and adjustment of the ball housing is possible.

Furthermore, the ball housing is formed so that in the connection fitting of the ball housing a seat for a screen and/or a backflow preventer is provided, which results in a space-saving arrangement for these structural parts.

To seal the overhead or lateral showerhead relative to the ceiling or wall, the connection element, the ball housing with the ball joint, and the jet producing unit are arranged in an installation housing. Said installation housing can also be shortened and/or be made of many parts.

Typically, in all fixtures which are installed in the ceiling or wall, for decorative reasons trims or frames are provided on the anterior side, which surround the fixture, in this case the side or ceiling showerhead, and form a seal relative to the wall. Typically, they also have sealing elements, which seal either between the fixture and the wall or between the trim and the interior of the fixture. In rectangular or square overhead or lateral showerheads, care must be taken that the trim, which covers the ball housing, is made so that during pivoting of the jet producing unit it does not afford a view of the interior or the construction of the showerhead.

In an embodiment, the trim can be made so that it covers the outwardly directed side of the ball housing and provides a view only of the area of the joint socket in which the ball of the joint and the adjacent jet producing unit are fastened.

For fastening the trim, which completely covers the outer flange of the ball housing, the ball housing is placed against the wall or ceiling surface and therefore secured simultaneously with the trim.

In addition, the overhead or lateral showerhead may have water draining devices at the outwardly and/or inwardly directed side of the ball housing, so that both the water that penetrates into the connection area behind the ball housing and the water that enters the space between the ball housing and jet producing unit can be brought out again from the lateral showerhead.

An embodiment of the invention provides that a regulating device is provided to control the flow volume at the overhead or lateral showerhead. To this end, an adjusting nut with variable opening cross sections is provided in the connection area of the ball joint, through which water flows, and the jet producing unit. When a plurality of overhead or lateral showerheads are connected to a common water connection, therefore a uniform spray pattern can be achieved by means of the regulation of the flow-through openings despite different water pressures at the individual overhead or lateral showerheads.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
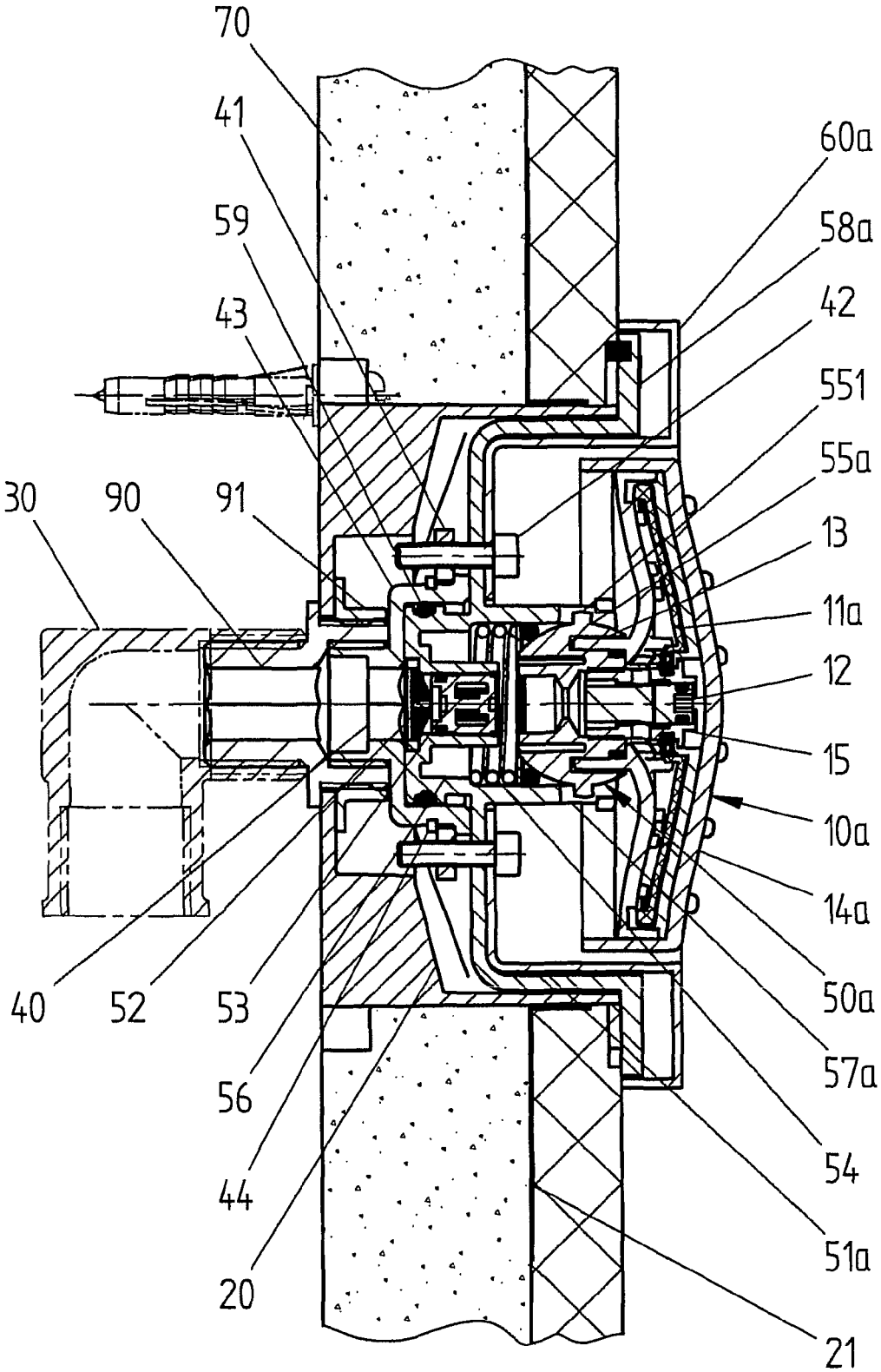
FIG. 1 shows a section through an overhead or lateral showerhead in the installed state with a minimal installation depth.

FIGS. 1 through 4 show a lateral showerhead with a pivotable jet producing unit 10*a*, 10*b* in the installed state. The lateral showerhead comprises a jet producing unit 10*a*, 10*b*, which is mounted pivotable in all directions in a ball housing 51*a*, 51*b*. Ball housing 51*a*, 51*b* is formed so that, on the one hand, it forms a joint socket 57*a*, 57*b* for a ball joint 55*a*, 55*b* (together forming a ball joint assembly 50*a*), through which water flows, but simultaneously surrounds the entire jet producing unit 10*a*, 10*b* and by means of an outer flange 58*a*, 58*b* forms a stop for the lateral showerhead at the wall surface.

A water connection 30, provided during the framing, is located in wall 70. First, a connection fitting 90 is mounted on water connection 30. Said connection fitting 90 has a flange against which a mounting box 20 lies, which is pushed onto connection fitting 90. Mounting box 20 is fastened from its inside with a threaded nut 91 to connection fitting 90. Further, after alignment mounting box 20 can be affixed to wall 70 by means of anchor bolts and screws. After plastering, mounting box 20 is sealed in the outer area relative to the wall with a sealing collar 21, onto which the decorative wall covering can be applied. Thereafter, mounting box 20 is shortened according to its installation depth, so that it ends flush with the wall covering, for example, the tile level.

During mounting of the lateral showerhead, first the required installation depth between the wall surface or outer edge of the installed mounting box 20 and the connection fitting 90 is to be measured. In addition to connection element 40, an extension piece 80 may be necessary, which must correspond to the connecting geometries of connection fitting 90 and connection element 40, to assure a tight connection.

Then, connection element 40 is fastened either directly to connection fitting 90 or extension piece 80. Connection element 40 with suitable tolerances has been adjusted beforehand to the measured installation depth.

On the side, facing the wall surface, of connection element 40, the cross section of connection element 40 increases abruptly, so that a seat 43 for a connection fitting 56 of ball housing 51*a*, 51*b* arises. In the delivered state, ball housing 51*a*, 51*b* is already equipped with a backflow preventer 53 and a screen 52, which is arranged in connection fitting 56. Ball housing 51*a*, 51*b* is already preassembled with a spring 54, a disk, and a seal, which are arranged below ball joint 55*a*, and ball joint 55*a*, 55*b* itself to form a subassembly.

For attachment of ball housing 51*a*, 51*b* to connection element 40, a rotatable annular disk 41, which is secured in the axial direction, is arranged at connection element 40. In the present case, annular disk 41 lies against a flange of connection element 40 and is fixed by means of a retaining ring 44. When the position of ball housing 51*a*, 51*b* is determined relative to the wall surface, ball housing 51*a*, 51*b* or according to the embodiment a subassembly comprising a trim 60*a* and ball housing 51*a* is screwed onto annular disk 41 with screws 42.

Because connection fitting 56 of ball housing 51*a*, 51*b* is mounted axially displaceable and tiltable in the seat of connection element 40, sealing ring 59 maintaining a water tight seal between these elements during their relative movement, ball housing 51*a*, 51*b* can be adjusted very precisely to the wall surface. Even after the adjustment of the length of connection element 40, a fine adjustment in the axial direction, therefore substantially perpendicular to the wall surface, and an angle adjustment to a possible slanting of the wall surface can still occur. The end position of ball housing 51*a*, 51*b* and therefore the lateral showerhead is fixed according to the orientation of ball housing 51*a*, 51*b* by screws 42. Alternatively, annular disk 41 may also be provided with fixed threaded bolts and ball housing 51*a*, 51*b* or the entire subassembly 51*a*, 60*a* be fastened with threaded nuts to the threaded bolts.

After ball housing 51*a*, 51*b*, in which ball joint 55*a*, 55*b* has already been premounted, is screwed together, jet producing unit 10*a*, 10*b*, which comprises a welding subassembly 11*a*, 11*b*, is fastened to ball joint 55*a*, 55*b*. Whereas a ring-shaped groove is provided on ball joint 55*a*, 55*b*, welding subassembly 11*a*, 11*b* has a mounting cylinder 13, which is pushed into the groove. The final fastening of welding subassembly 11*a*, 11*b*, which comprises a water distribution chamber and a spray producer with water outlet openings, to ball joint 55*a*, 55*b* occurs via a central screw 15, in which a regulating screw 12 is integrated. The flow volume per lateral showerhead is set by means of regulating screw 12. In an arrangement of a plurality of lateral showerheads in a row to a water connection, therefore the flow volume can be adjusted to the different pressure conditions, so that uniform spray patterns can be generated. Finally, a cover 14*a*, 14*b*, which covers welding subassembly 11*a*, 11*b* all around, can be pushed onto welding subassembly 11*a*, 11*b*.

Very small installation depths of less than 5 cm can be realized by the compact design in the lateral showerhead of the invention. With a similar lateral showerhead design, it is also possible, however, to achieve installation depths of 9 to 10 cm by means of the variable connection element 40.

Figure 2:
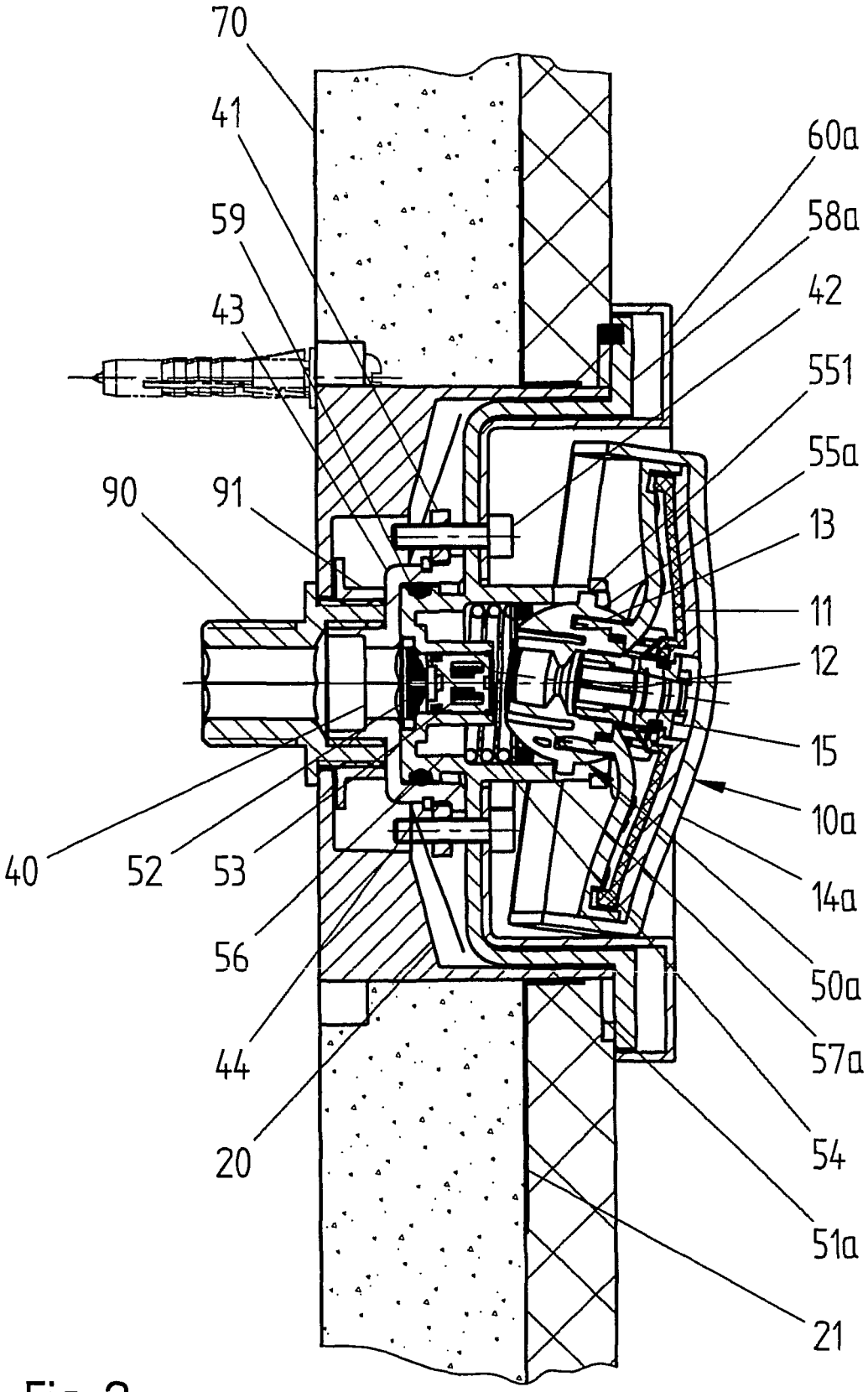
FIG. 2 shows a section through the overhead or lateral showerhead of FIG. 1 in the pivoted state.
Figure 3:
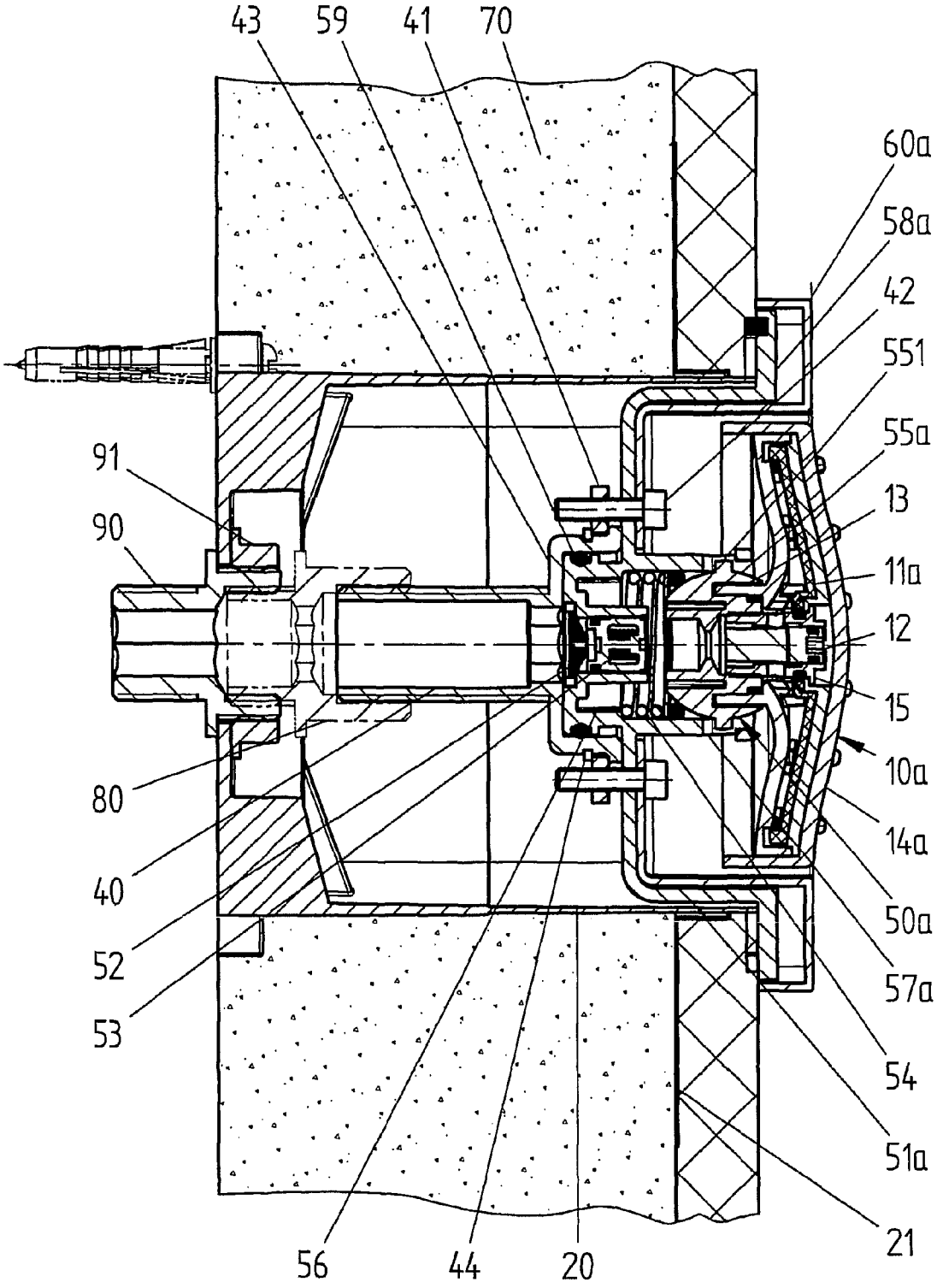
FIG. 3 shows a section through an overhead or lateral showerhead in the installed state with a maximum installation depth.

FIGS. 1 through 3 show lateral showerheads with a pivotable angular jet producing unit 10*a*. In the mounting of the lateral showerhead, the precise orientation of the angular jet producing unit 10*a* relative to ball housing 51*a* is the main focus. For this reason, ball joint 55*a* has a component for rotational fixation 551 of jet producing unit 10*a*. For this purpose, fittings or pins can be provided on ball joint 55*a*, which correspond to the recesses provided for them in joint socket 57*a*, so that jet producing unit 10*a* can be installed only in certain predefined positions.

In the shown lateral showerheads, a trim 60*a* is provided, which surrounds the outwardly directed side of ball housing 51*a* with the exception of joint socket 57. This is screwed together with ball housing 51*a* and secured. The mounting of jet producing unit 10*a* occurs thereafter.

Figure 4:
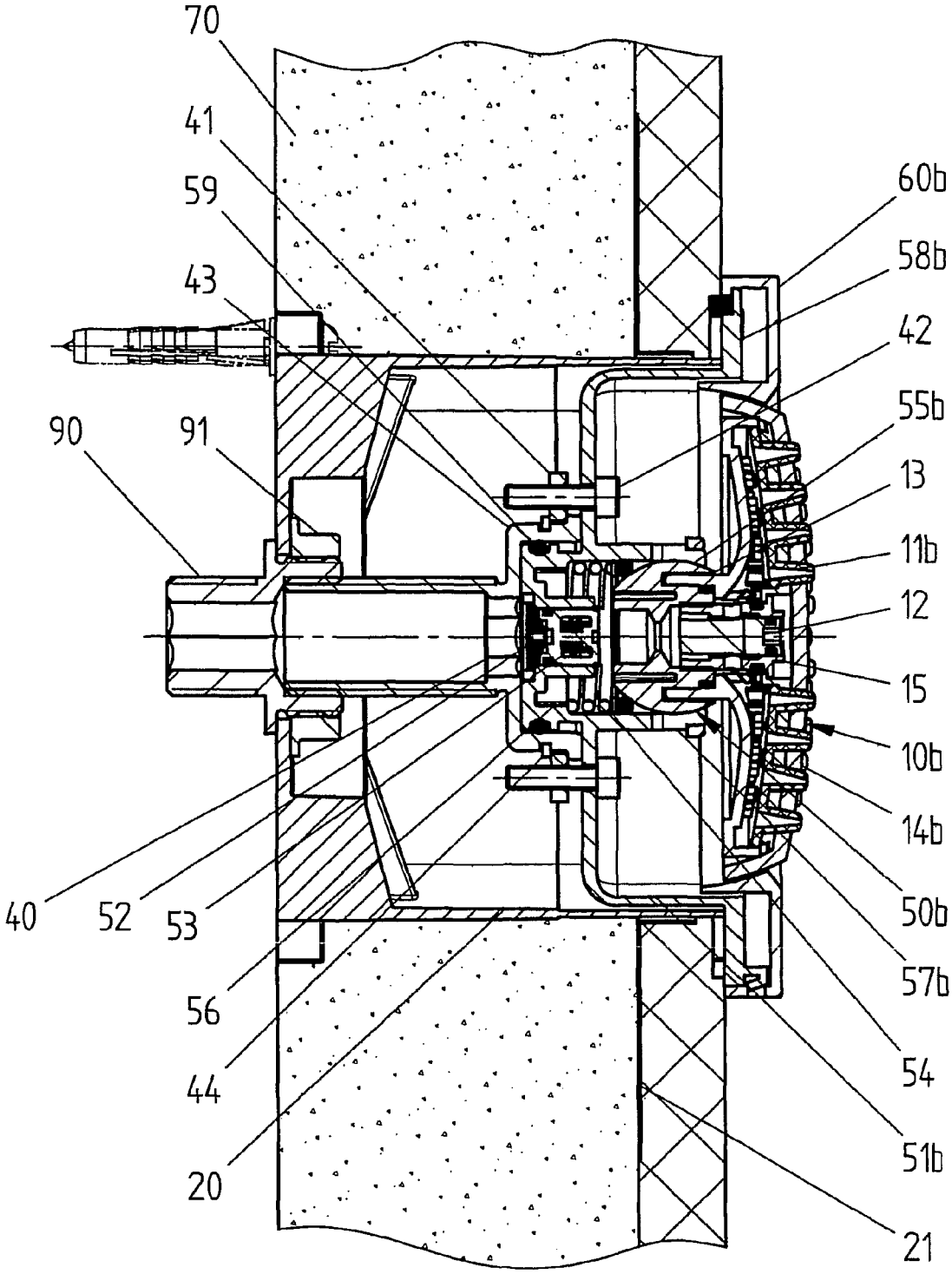
FIG. 4 shows a section through a variant of an overhead and lateral showerhead in the installed state.

In contrast to this, FIG. 4 shows a lateral showerhead with a pivotable round jet producing unit 10*b* in the installed state. In contrast to the angular design, in the round variant no rotational fixation is needed during the fastening of jet producing unit 10*b*. During the mounting process, the fastening of jet producing unit 10*b* occurs before the fastening of trim 60*b*. Instead of a screw connection, ball housing 51*b* is provided with latching hooks and trim 60*b* is provided with corresponding recesses or grooves, so that trim 60*b* can be attached form-fittingly to ball housing 51*b*.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An overhead or lateral showerhead for installation in a ceiling or wall surface, the showerhead comprising:

a ball housing having a first end defined by a base wall and an open second end spaced from the base wall in a first direction, an interior between the base wall and the open second end, an outer flange at the open second end, a ball-receiving socket in the interior on a first side of the base wall and a connection fitting projecting away from the base wall on a second side of the base wall opposite the first side;

a pivotable jet producing unit having a ball portion mounted in the ball-receiving socket in the ball housing the ball housing adapted to have water flow therethrough, the ball housing substantially surrounding the jet producing unit, the outer flange extending towards the ceiling or the wall surface; and a connection element having a receiver and being arranged between a water connection and the ball housing, wherein the connection fitting is mounted in the receiver and wherein the ball and the ball-receiving socket are located outside the receiver.

2. The overhead or lateral showerhead according to claim 1, wherein a fastener is provided with which the ball housing is fixable to the connection element and wherein the outer flange of the ball housing is secured against the ceiling or wall surface via the fastener.

3. The overhead or lateral showerhead according to claim 2, wherein the ball housing is fastened by screws to an annular disk mounted rotatably on the connection element.

4. The overhead or lateral showerhead according to claim 1, wherein the connection element comprises a plurality of parts.

5. The overhead or lateral showerhead according to claim 1, wherein the ball housing comprises a connection fitting, which is guided tiltably and displaceably in a seat of the connection element.

6. The overhead or lateral showerhead according to claim 5, wherein in the connection fitting of the ball housing, a seat for a screen and/or a backflow preventer is arranged.

7. The overhead or lateral showerhead according to claim 1, wherein the connection element, the ball housing with the ball joint, and the jet producing unit are arranged in a box unit.

8. The overhead or lateral showerhead according to claim 1, wherein a trim is provided, which covers the outwardly directed side of the ball housing and thereby the ball housing is placed against the ceiling or wall surface.

9. The overhead or lateral showerhead according to claim 1, wherein a regulating device is provided to control the flow volume.

10. The overhead or lateral showerhead according to claim 9, wherein in the connecting area of the ball joint, through which water flows, and the jet producing unit an adjusting nut with variable opening cross sections is arranged.

11. An arrangement of overhead or lateral showerheads according to claim 1, wherein at least one additional overhead or lateral showerhead is provided, which is connected to a water connection.

12. The overhead or lateral showerhead according to claim 1, wherein the connection fitting includes a first portion at the ball housing and a severable portion extending from the first portion, at least a part of the severable portion being severable from the first portion before the connection fitting is mounted in the receiver to establish a distance between the outer flange and the water connection when the showerhead is installed in a ceiling or wall surface.

13. An overhead or lateral showerhead for installation in a ceiling or wall surface, the showerhead comprising:

a ball housing having a base wall, at least one side wall projecting in a first direction from the base wall and defining an interior and an open end of the ball housing, an outer flange at the open end of the ball housing, a socket in the interior at a first side of base wall and a connection fitting projecting at a second side of the base wall opposite the socket;

a pivotable jet producing unit in the interior and having a ball mounted in the socket; and a connection element having receiver and being arranged between a water connection and the ball housing and providing a flow path from the water connection to the interior, wherein the connection fitting is mounted in the receiver and wherein the ball in the socket is on the opposite side of the base wall from the connection fitting.

14. The overhead or lateral showerhead of claim 13, wherein the pivotable jet producing unit includes a wall having a plurality of jets, wherein the wall is located at the second opening and faces away from the base wall and has a peripheral edge, and wherein the pivotable jet producing unit is pivotable from a first position wherein a first portion of the peripheral edge is located in the interior and a second position wherein the first portion of the peripheral edge is located outside the interior.

15. The overhead or lateral showerhead of claim 13, wherein the base wall, the at least one side wall, the outer flange, the socket and the connection fitting comprise portions of a unitary molded member.

16. The overhead or lateral showerhead of claim 13, wherein the ball is located entirely in the interior.

17. The overhead or lateral showerhead according to claim 13, wherein the connection fitting includes a first portion at the ball housing and a severable portion extending from the first portion, at least a part of the severable portion being severable from the first portion before the connection fitting is mounted in the receiver to establish a distance between the outer flange and the water connection when the showerhead is installed in a ceiling or wall surface.

* * * * *